US012768550B2

(12) United States Patent
Zhong et al.

(10) Patent No.: US 12,768,550 B2
(45) Date of Patent: Oct. 20, 2026

(54) HUMIDIFIER

(71) Applicant: GD MIDEA ENVIRONMENT APPLIANCES MFG CO., LTD., Zhongshan (CN)

(72) Inventors: Shaohua Zhong, Zhongshan (CN); Daoyue Liu, Zhongshan (CN); Xiangwu Zhang, Zhongshan (CN); Yangyang Wang, Zhongshan (CN); Jialuo Yu, Zhongshan (CN)

(73) Assignee: GD MIDEA ENVIRONMENT APPLIANCES MFG CO., LTD., Zhongshan (CN)

( * ) Notice: Subject to any disclaimer, the term of this patent is extended or adjusted under 35 U.S.C. 154(b) by 356 days.

(21) Appl. No.: 18/660,050

(22) Filed: May 9, 2024

(65) Prior Publication Data

US 2024/0377083 A1 Nov. 14, 2024

(30) Foreign Application Priority Data

May 12, 2023 (CN) ..... 202321150675.5

(51) Int. Cl.
*F24F 6/02* (2006.01)
*F24F 6/00* (2006.01)
*F24F 140/00* (2018.01)

(52) U.S. Cl.
CPC ..... *F24F 6/025* (2013.01); *F24F 2006/008* (2013.01); *F24F 2140/00* (2018.01)

(58) Field of Classification Search
CPC .. F24F 6/025; F24F 2006/008; F24F 2140/00; F24F 11/0008; F24F 11/30; F24F 11/89
See application file for complete search history.

(56) References Cited

U.S. PATENT DOCUMENTS

2011/0232775 A1 9/2011 Chale et al.

FOREIGN PATENT DOCUMENTS

| | | | |
|---|---|---|---|
| CN | 201992756 U | * | 9/2011 |
| CN | 209296097 U | | 8/2019 |
| CN | 114484658 A | * | 5/2022 |
| CN | 220379872 U | | 1/2024 |
| JP | S40008704 Y1 | | 3/1965 |

(Continued)

OTHER PUBLICATIONS

English Machine Translation CN 201992756 U (Year: 2011).*

(Continued)

*Primary Examiner* — Charles S Bushey
(74) *Attorney, Agent, or Firm* — Anova Law Group, PLLC

(57) ABSTRACT

A humidifier includes a base including a water reservoir cavity, a trigger switch provided at the base, and a trigger component located in the water reservoir cavity. An outer side of the trigger switch is provided with a waterproof protective cover. The trigger component is configured to, in response to a water level in the water reservoir cavity rising to a predetermined water level line, push the waterproof protective cover to trigger the trigger switch to control the humidifier to work. A wall thickness the waterproof protective cover at a position where the waterproof protective cover contacts the trigger component is less than a wall thickness of the waterproof protective cover at other positions of the waterproof protective cover.

20 Claims, 6 Drawing Sheets

(56) References Cited

FOREIGN PATENT DOCUMENTS

| | | | |
|---|---|---|---|
| JP | S52017870 | U | 2/1977 |
| JP | H0552372 | A | 3/1993 |
| JP | H10232037 | A | 9/1998 |
| JP | 2000257928 | A | 9/2000 |
| JP | 2000266370 | A | 9/2000 |
| JP | 2001032360 | A | 2/2001 |
| JP | 2002025387 | A | 1/2002 |
| JP | 3143587 | U | 7/2008 |
| WO | WO 2019111667 | A1 * | 6/2019 |

OTHER PUBLICATIONS

English Machine Translation WO 2019111667 A1 (Year: 2019).*
English Machine Translation CN 114484658 A (Year: 2022).*
The Japan Patent Office (JPO) The Decision to Grant a Patent for Application No. 2024-056773 Apr. 8, 2025 5 Pages (including translation).

* cited by examiner

HUMIDIFIER

CROSS-REFERENCE TO RELATED APPLICATION

This application claims priority to Chinese Patent Application No. 202321150675.5, filed on May 12, 2023, the entire contents of which are incorporated herein by reference.

TECHNICAL FIELD

The present disclosure relates to the technical field of household appliance, in particular to a humidifier.

BACKGROUND

With the improvement of people's living quality, humidifier has gradually been widely used. Humidifier generally includes a shell, the shell is provided with a mist port, the shell is equipped with a water trough, the water in the water trough is atomized and then discharged to the air through the mist port for humidifying the air.

However, in the related technology, the humidifier will still work in a state of water shortage, which may result in a safety hazard.

SUMMARY

In order to solve or at least partially solve technical problems described above, the embodiments of the present disclosure provide a humidifier.

The embodiments of the present disclosure provide a humidifier, comprises base, wherein the base includes a water reservoir cavity; a trigger switch provided at the base and a trigger component located in the water reservoir cavity, wherein outside of the trigger switch is provided with a waterproof protective cover, the trigger component is used to push upward the waterproof protective cover when a water level of the water reservoir cavity rises to a first predetermined water level line to trigger the trigger switch to control the humidifier work; wherein a wall thickness of the position of the waterproof protective cover where the waterproof protective cover contacts the trigger component is less than the wall thickness of other position of the waterproof protective cover.

The humidifier provided in the embodiments of the present disclosure makes the trigger component located in the water reservoir cavity by setting trigger switch and trigger component on the base, and sets the waterproof protective cover on the outer side of the trigger switch. The trigger component pushes upward the waterproof protective cover when a water level of the water reservoir cavity rises to a first predetermined water level line for triggering the trigger switch to control the humidifier to work. In other words, only when the water level rises to the first predetermined water level line, the trigger component may push upward the waterproof protective cover for triggering the trigger switch to control the humidifier to work, which thereby controls the humidifier flexibly according to the height of the water level. In a certain degree, it can avoid occurrence of the phenomenon of unsafe accidents caused by that the humidifier still work when there is a shortage of water, improve the safety of use of the humidifier, and has a better user experience. At the same time, due to that the wall thickness of the position of the waterproof protective cover where the waterproof protective cover contacts the trigger component is smaller than other position of the waterproof protective cover, it not only achieves sealing and waterproofing of the trigger switch by the waterproof protective cover in a certain degree, but also improves the sensitivity of the trigger switch and further ensures the safety of use of the humidifier.

In some embodiments, the humidifier further comprises a heating component; the base further includes a water trough, wherein the water trough connects with the water reservoir cavity, the heating component is used to heat the water in the water trough for forming mist; when the water level of the water reservoir cavity rises to the first predetermined water level line, the trigger switch is triggered and opens the heating component; after the water level of the water reservoir cavity falls to the second predetermined water level line, the trigger switch is cut down and the heating component is turned off; wherein the second predetermined water level line is lower than the first predetermined water level line.

In some embodiments, the trigger switch is located above the trigger component; the waterproof protective cover includes a cover body, the cover body covers at least one side of the trigger switch toward the trigger component, the trigger component is used to push upward the bottom wall of the cover body for triggering the trigger switch to control the humidifier to work when the water level of the water reservoir cavity rises to the first predetermined water level line; the wall thickness of the bottom wall of the cover body is less than or equal to the wall thickness of the other position of the cover body.

In some embodiments, the base is provided with a mounting member, the mounting member is located above the water reservoir cavity, the trigger switch is installed on the mounting member; the waterproof protective further includes an assembly component, the assembly component is provided at the cover body, the assembly component is connected to the mounting member in coordination, and the wall thickness of the assembly component is greater than the wall thickness of the cover body. The wall thickness of the groove wall of the assembly groove is greater than the wall thickness of the cover body.

In some embodiments, the convex part is sealed and matched with the assembly groove; and/or, one side of the cover body that is away from the trigger component includes an opening for at least the trigger switch to enter, and the assembly component is provided at the opening; and/or, the assembly groove is circular assembly groove arranged along the circumference of the cover body; and/or, the groove wall of the assembly groove includes two opposite side groove walls, the wall thicknesses of both the two side groove walls are greater than the wall thickness of the cover body, and the wall thicknesses of the two side groove walls are equal.

In some embodiments, the mounting member includes a support wall arranged horizontally and an abutment wall extending from the outer edge of the support wall in a direction away from the water reservoir cavity; the outer wall of the assembly component is formed with a first matching surface arranged horizontally and a second matching surface extending from the edge of the first matching surface in a direction away from the cover body; when the waterproof protective cover is connected with the mounting member, the first matching surface is located at the support wall and is sealed and connected with the support wall, the second matching surface abuts against the abutment wall.

In some embodiments, the trigger component is float, wherein there is a floating gap between the float and the inner side wall of the water reservoir cavity for the float to float up and down.

In some embodiments, there is a guiding structure arranged between the water reservoir cavity and the float used for guiding the float.

In some embodiments, the guiding structure includes a guiding groove provided at one of the side wall of the float and the cavity wall of the water reservoir cavity, and a guiding rib provided at other one of the side wall of the float and the cavity wall of the water reservoir cavity. When the float floats up and down, the guiding rib moves along the guiding groove.

In some embodiments, the float include a float body and a trigger member provided at the side of the float body toward the waterproof protective cover, the trigger member is used to push upward the waterproof protective cover for triggering the trigger switch.

In some embodiments, the humidifier further includes a water tank provided at the base; the water tank is connected with the water reservoir cavity and supplies water to the water reservoir cavity; when the water level of the water reservoir cavity rises to the first predetermined water level line, the trigger switch is triggered, and the water tank stop supplying water to the water reservoir cavity; when the water level of the water reservoir cavity falls to the second predetermined water level line, the trigger switch is cut down, and the water tank continues to supply water to the water reservoir cavity; wherein the second water level line is lower than the first water level line.

BRIEF DESCRIPTION OF THE DRAWINGS

The drawings herein are incorporated into and constitute a part of the specification, which show the embodiments of the present application and illustrate the principles of the present application together with the specification.

In order to make the technical solutions described in the embodiments of the present disclosure clearer, the drawings used for the description of the embodiments will be briefly described. Apparently, the people skilled in the art may acquire other drawings based on these drawings, without making any creative efforts.

Figure 1:
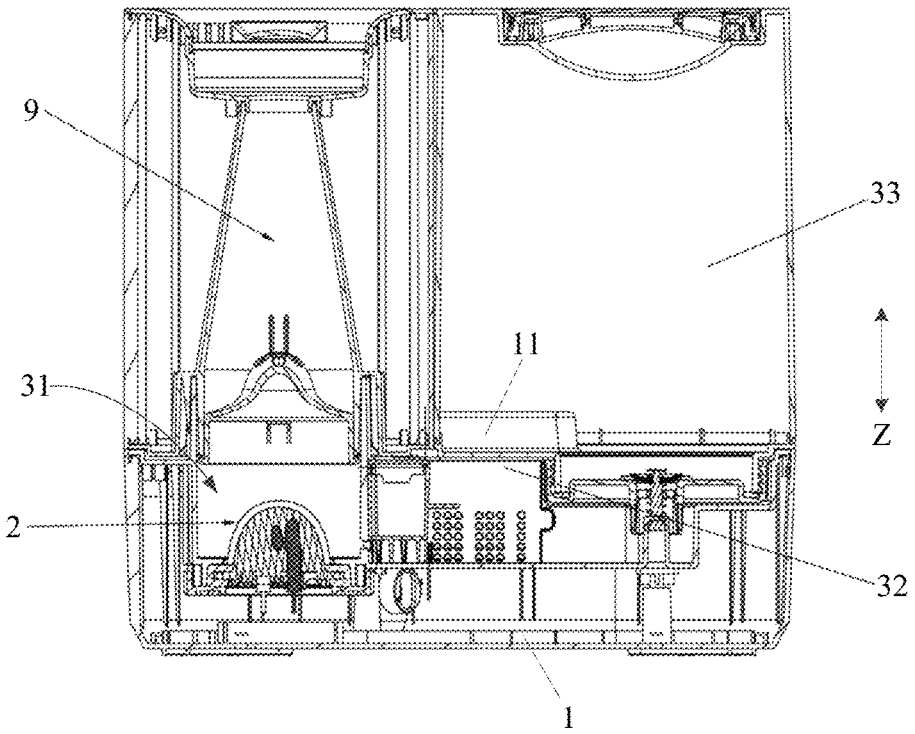
FIG. 1 is a schematic assembly diagram of the humidifier according to the embodiment in the present disclosure.

Reference numerals: 1. base; 11, mounting member; 111. cover plate; 112. switch base; 113. support wall; 114. abutment wall; 2. heating component; 31. water trough; 32. water reservoir cavity; 33. water tank; 4. trigger switch; 5. trigger component; 51. float body; 52. trigger member; 6. waterproof protective cover; 61. cover body; 62. opening; 63. assembly groove; 631. side groove wall; 64. assembly component; 641. first matching surface; 642. second matching surface; 71. switch bracket; 711. convex part; 72. support; 73. water guiding hole; 81. guiding groove; 82. guiding rib; 9. mist exhausting assembly; 91. mist exhausting port.

DETAILED DESCRIPTION

In order to be able to understand the object, features and advantages of the embodiments of the present disclosure, implementations of the disclosure will now be further described, by way of embodiments only, with reference to the drawings. It should be noted that non-conflicting details and features in the embodiments of the present disclosure may be combined with each other.

In the following descriptions, many specific details are set forth so as to provide a thorough understanding of the present disclosure. However, the present disclosure may be implemented in other manners other than what are described herein. obviously, the embodiments in the specification are only a part, not all, of embodiments of the present disclosure.

Referring to FIG. 1 to FIG. 9, some embodiments of the present disclosure provides a humidifier, the humidifier comprises a base 1, the base 1 having a water reservoir cavity 32. Specifically, the base 1 is provided with a trigger switch 4 and a trigger component 5 disposed in the water reservoir cavity 32. The trigger switch 4 is provided with a waterproof protective cover 6 on the outside of the trigger switch 4, the trigger component 5 is used to push upward the waterproof protective cover 6 when the water level of the water reservoir cavity 32 rises to a first predetermined water level line, so as to trigger the trigger switch 4 to control the humidifier to work.

In other words, the trigger component 5 is adapted to rise and fall in response to the changes of the water level of the water reservoir cavity 32, and the trigger component 5 is a component that is buoyant in water.

In specific implementations, the trigger switch 4 may, for example, be set above the water reservoir cavity 32. The trigger switch 4 include a switch spring, when the water level of the water reservoir cavity 32 rises to the first predetermined water level line, the trigger component 5 may moves upwardly to push upward the waterproof protective cover 6 on the outside of the trigger switch 4 to push upward the switch spring of the trigger switch for triggering the trigger switch 4, and thereby controlling the humidifier to work.

Exemplarily, when the water level of the water reservoir cavity 32 falls, the trigger component 5 may fall with the fall of the water level, and after the water level is lower than the first predetermined water level line, the above pushing force on the switch spring disappears, the switch spring resets and the trigger switch is disconnected. In other words, when the water level rises to the first predetermined water level line, the trigger component 5 will resist the waterproof protective cover 6 to trigger the trigger switch 4 for controlling the humidifier to work, so as to flexibly control the work of the humidifier according to the height of the water level, which can in certain extent avoid the occurrence of unsafe accidents that occurs due to the humidifier still work when there is lack of water in the humidifier, and improve the safety of the use of the humidifier.

In some embodiments, the wall thickness of the waterproof protective cover 6 in contact with the trigger component 5 is less than the wall thickness of the other position of the waterproof protective cover 6.

Such setting can make the waterproof protective cover 6 to achieve a certain degree of sealing and waterproofing effect on the trigger switch 4, while also improve the sensitivity of the trigger component 5 to trigger the trigger switch 4, which can further ensure the safety of use of the humidifier.

The humidifier in the embodiment is equipped with a trigger switch 5 and water reservoir cavity 32 provided at the base 1, enabling the trigger component 5 to be located in the water reservoir cavity 32, and sets the waterproof protective cover 6 on the outside of the trigger switch 4. When the water lever of the water reservoir cavity 32 rises to the first predetermined water level line, the trigger component 5 can push upward the waterproof protective cover 6 to trigger the trigger switch 4 for controlling the humidifier to work. In other words, only when the water level rises to the first predetermined water level line, the trigger component 5 can push upward the waterproof protective cover 6 to trigger the trigger switch 4 for controlling the humidifier to work, which can flexibly control the work of the humidifier according to the height of the water level, in certain extent avoid the occurrence of unsafe accidents that occurs due to the humidifier still work when there is lack of water in the humidifier, and improve the safety of the use of the humidifier, the user experience may be better. Moreover, because the wall thickness of the waterproof protective cover 6 in contact with the trigger component 5 is less than the wall thickness of the other position of the waterproof protective cover 6, it can make the waterproof protective cover 6 to achieve a certain degree of sealing and waterproofing effect on the trigger switch 4, while also improve the sensitivity of the trigger component 5 to trigger the trigger switch 4, which can further ensure the safety of use of the humidifier.

In some embodiments, referring to FIG. 1 to FIG. 9, the humidifier further include heating component 2, and the base 1 further includes water trough 31, the water trough 31 being connected to the water reservoir cavity 32 and the heating component 2 being used to heat the water in the water trough 31 to form a mist. Wherein the heat member 2, for example, can be provided at a bottom wall of the water trough 31.

Specifically, when the water level of the water reservoir cavity 32 rises to the first predetermined water level line, the trigger switch 4 is triggered and turns on the heating component 2; after the water level of the water reservoir cavity 32 falls to a second predetermined water level line, the trigger switch 4 is disconnected and the heating component 2 is turned off; wherein the second predetermined water level line is lower than the first predetermined water level line.

That is to say, when the water level of the water reservoir cavity 32 rises to the first predetermined water level line, the trigger component 5 can push upward the waterproof protective cover 6 on the outside of the trigger switch 4 to push upward and trigger the switch spring of the trigger switch 4 for triggering the trigger switch 4 and causing the heating component 2 to conduct electricity, wherein the heating component 2 can heat the water in the water trough 31 for forming mist. When the water level of the water reservoir cavity 32 falls to the second predetermined water level line, the pushing force on the switch spring of the trigger switch 4 disappears, and the switch spring resets, at this time the heating component 2 can be cut off the conductivity and stop work, which can avoid the occurrence of the situation such as overheating and so on with lack of the water and improve the safety of use of the humidifier.

Exemplarily, the water level of the water reservoir cavity 32 is balanced with the water level of the water trough 31, and when the water level of the water reservoir cavity 32 rises to the first predetermined water level line and above, the trigger component 5 pushes upward the spring of the trigger switch to trigger the trigger switch 4 for enabling the heating component 2 conducting electrically. The heating component 2 can heat the water of the water trough 31. When the water level of the water reservoir cavity 32 falls to the second predetermined water level and below, the trigger component 5 separates from the spring of the trigger switch 4 to cut off the electrical conduction between the heating component 2 and the trigger switch 4, and the heating component 2 stops working.

In some implementations, the humidifier further includes a mist exhausting assembly, the mist exhausting assembly being disposed over the water trough. When the humidifier is in work, the heating component 2 heats the water in the water trough 31 for forming mist and the mist can be discharged out through the mist exhausting assembly 9 for humidifying the air.

In some embodiments, as shown referring to FIG. 1 to FIG. 6, the trigger switch 4 is disposed above the trigger component 5, which can effectively prevent water from entering into the electrical components of the trigger switch 4 in a certain extent for reducing the occurrence of the phenomenon that water enter into the trigger switch 4 and affects the service life.

In some embodiments, the waterproof protective cover 6 comprises a cover body 61, the cover body 61 being located at least one side of the trigger switch 4 toward the trigger component 5, the trigger component 5 being used to push upward the bottom wall of the cover body 61 when the water level rises to the first predetermined water level line to trigger the trigger switch 4 for control the humidifier to work.

Figure 5:
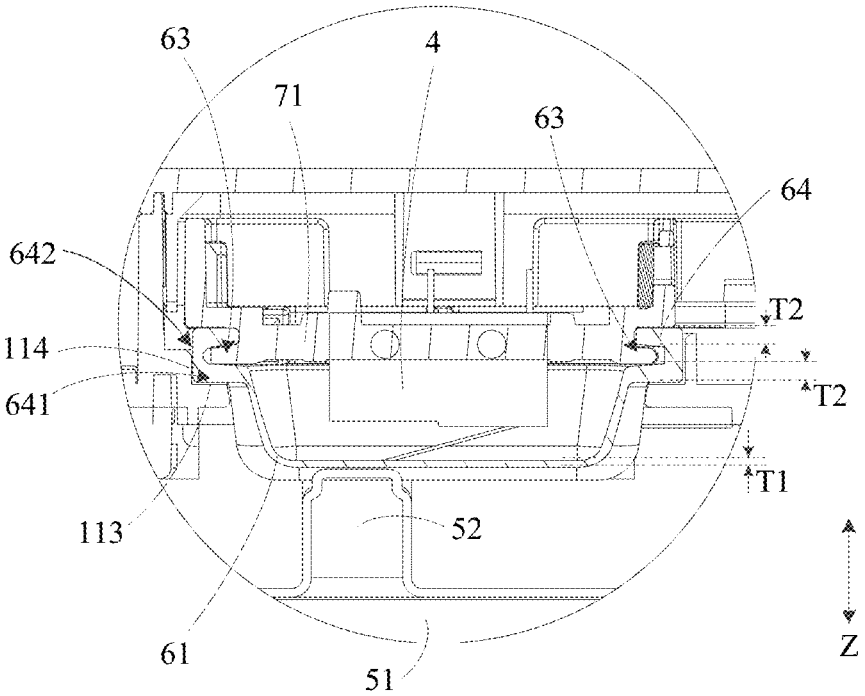
FIG. 5 is an enlarged structural diagram of a part of the humidifier according to the embodiment in the present disclosure.
Figure 9:
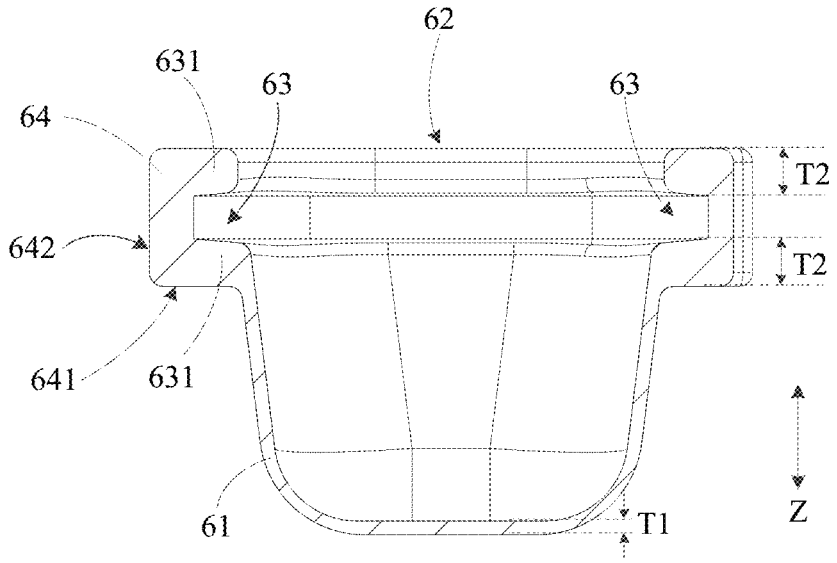
FIG. 9 is a sectional view of the waterproof protective cover shown in FIG. 8 along A-A.

Specifically, a wall thickness of the bottom wall of the cover body 61 is less than or equal to a wall thickness of other location of the cover body 61. Exemplarily, as shown in FIG. 5 and FIG. 9, the cover body 61 includes the bottom wall and a side wall extending upward from the edge of the bottom wall, and the wall thickness of the bottom wall is equal to a wall thickness of the side wall. When the bottom wall is pushed upward by the trigger component 5, the side wall of the cover body 61 will also be deformed in a certain degree, which can cause the trigger switch being triggered.

It should be noted that, as shown referring to FIG. 5 and FIG. 9, the wall thickness T1 of the bottom wall of the cover body 61 is the dimension of the bottom wall of the cover body 61 along the direction from the trigger component 5 to the trigger switch (Z-direction referring to FIG. 5 and FIG. 9).

In some embodiments, the waterproof protective cover 6 can be, for example, silicone cover, which is soft and has a good sealing, which can ensure the sealing the trigger switch 4. And the trigger component 5 rises and touches the silicone cover, soft silicone cover can deform synchronously and touch the trigger switch 4 for ensuring the sensitivity of triggering.

The bottom wall of the cover body 61 is located between the trigger component 5 and the spring of the trigger switch 4. In the specific use, when the water level of the water reservoir cavity 32 rises, the trigger component 5 moves upward to push upward the bottom wall of the cover body 61 for pushing upward the spring of the trigger switch 4 to trigger the trigger switch 4 and enable the heating component 2 to conduct electronically.

Due to the wall thickness of the bottom wall of the cover body 61 being thin, while the cover body 61 achieves sealing and waterproofing for the trigger switch 4, the cover body 61 also enables the trigger component 5 more sensitive to the triggering and cutting of the trigger switch, which can enable the conductive and cutting response of the heating component 2 more timely and sensitive, and improve the safety of use of the humidifier.

In some embodiments, as shown referring to FIG. 1 to FIG. 6, the base 1 is provided with a mounting member 11, wherein the mounting member 11 is located above the water reservoir cavity 32 and the trigger switch 4 is mounted on the mounting member 11. As shown referring to FIG. 3 to FIG. 6, the mounting member 11 can include, for example, a switch base 112, a switch bracket 71, wherein one side of the switch base 112 toward the water reservoir cavity 32 is provided with an avoidance opening, the trigger switch 4 is connected in the switch base 112 through the switch bracket 71, the waterproof protective cover 6 is provided at the outside of the trigger switch and the waterproof protective cover 6 is threaded through the avoidance opening and sealed with the avoidance opening of the switch base 112. Furthermore, the top sealing cover of the switch base 112 is equipped with a cover plate 111 for enabling the trigger switch 4 being in a relatively sealed space, which can provide good waterproof protection to the trigger switch 4.

Figure 3:
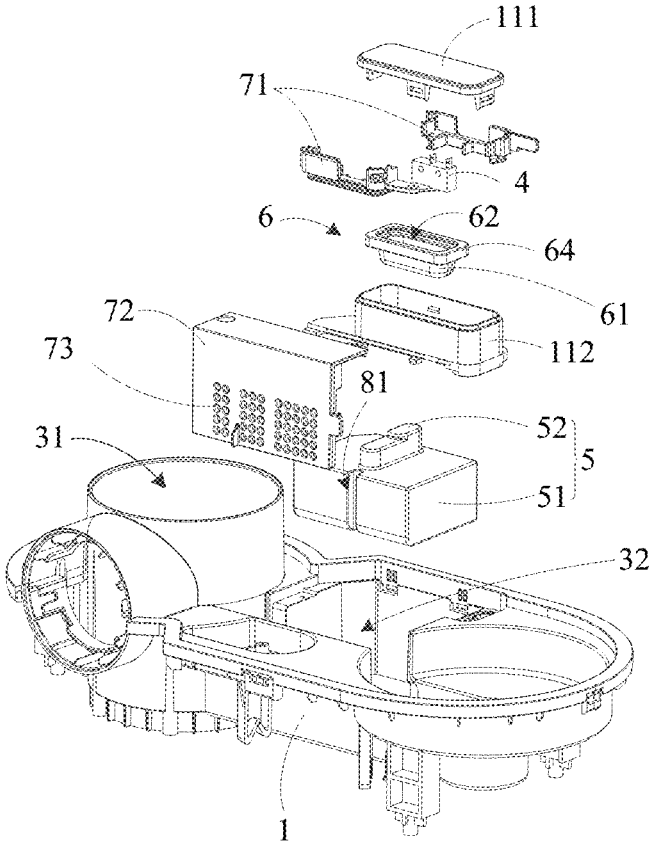
FIG. 3 is an exploded structural diagram of a part of the humidifier according to the embodiment in the present disclosure.

As shown referring to FIG. 3, the switch bracket 71 can include, for example, two sub-brackets, which are set opposite to each other and can be detachably connected, and the two sub-brackets together define a space for assembling the trigger switch 4. Specifically, one of the two sub-brackets is equipped with a plug rod, the trigger switch 4 is equipped with a socket for the plug rod to extend into. The trigger switch 4 is firstly pre-assembled on the one of the sub-brackets by the fit of the plug rod and the socket, and then the two sub-brackets are connected together, so the switch bracket 71 is assembled with the trigger switch 4 together. The waterproof protective cover 6 can then be set over the outside of the switch bracket 71 and the trigger switch 4.

In some embodiments, as shown referring to FIG. 4 to FIG. 9, the waterproof protective cover 6 further includes an assembly component 64, which is provided at the cover body 61. the assembly component 64 is cooperatively connected with the mounting member 11, and a wall thickness of the assembly component 64 is greater than the wall thickness of the cover body 61. in other words, the cover body 61 is used to achieve cooperation with the trigger component 5 to trigger the trigger switch 4, and the assembly component 64 is set to cooperate with the mounting member 11 to achieve the assembly of the waterproof protective cover 6. At the same time, the wall thickness of the assembly component 64 is greater than the wall thickness of the cover body 61, which can improve the strength of the connection between the waterproof protective cover 6 and the mounting member 11 in a certain degree and avoid occurrence of the phenomenon that the waterproof protective cover 6 is damaged due to pressure during assembly. It effectively protects the waterproof protective cover 6 and improves the protective effect of the waterproof protective cover 6 to the trigger switch 4.

Among them, the assembly component 64 can be, for example, integrated with the cover body 61 to improve the overall structural strength of the waterproof protective cover 6.

In some embodiments, as shown in FIG. 4 to FIG. 9, the assembly component 64 can include assembly groove 63, the mounting member 11 is provided with a convex part 711. When the waterproof protective cover 6 is connected with the mounting member 11, the convex part 711 can extend into the assembly groove 63 for easy assembly, reliable and stable connection. The convex part 711 can be, for example, provided at the outside wall of the switch bracket 71. In some embodiments, the sealing fit between the convex part 711 and the assembly groove 63 can further improve the waterproof and sealing performance of the waterproof protective cover 6 to the trigger switch 4 and be useful to extend the service life of the humidifier. It further improves the sealing performance of the waterproof protective cover 6 to the trigger switch 4.

In some embodiments, as shown in FIG. 3 to FIG. 9, one side of a cover trigger component 5 of the cover body 61 include an opening 62, which can at least be entered for trigger switch 4. The assembly component 64 is located at the opening 62 for easy assembly and can provide waterproof effect in a certain degree.

Figure 7:
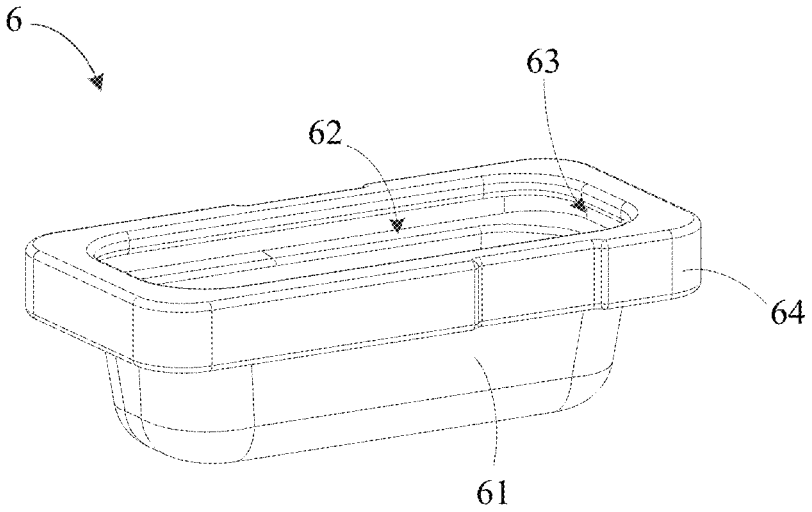
FIG. 7 is an axonometric diagram of the waterproof protective cover of the humidifier according to the embodiment in the present disclosure.
Figure 8:
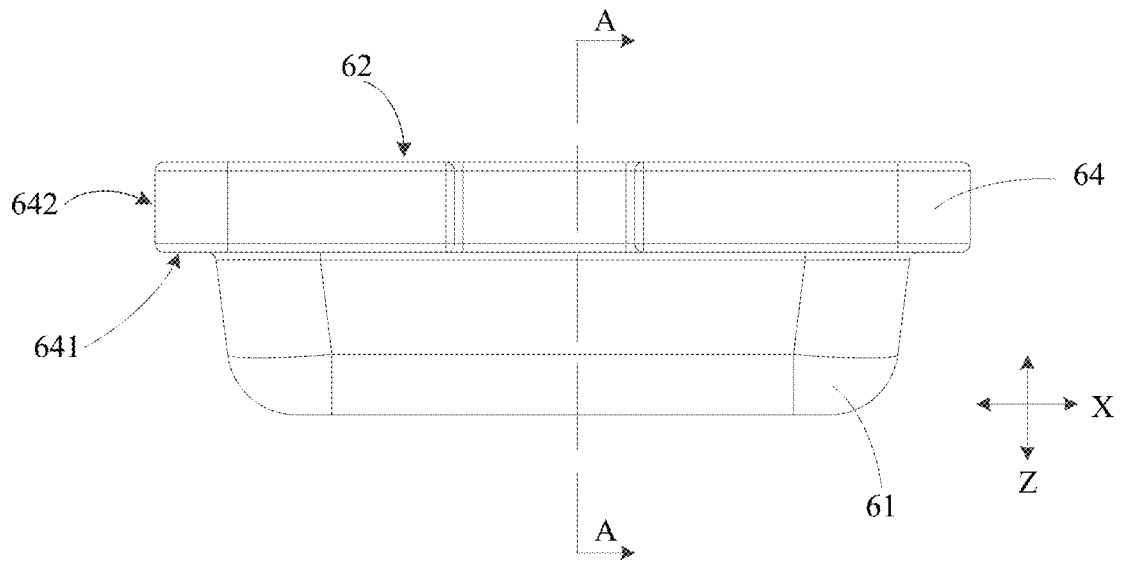
FIG. 8 is a front view of the waterproof protective cover of the humidifier according to the embodiment in the present disclosure.

In some embodiments, as shown in FIG. 7 to FIG. 9, the assembly groove 63 is a circular assembly groove arranged along the circumference of the cover body 61. It can improve the uniformity of force during assembly and facilitate assembly. It also can increase the contact connection area between the switch bracket 71 and the waterproof protective cover 6, which can improve the bonding strength between the switch bracket 71 and the waterproof protective cover 6.

Specifically, the wall thickness of the groove wall of the assembly groove 63 is greater than the wall thickness of the cover body 61, which can improve the strength of the connection between the assembly component 64 and the mounting member 11 and avoid occurrence of phenomenon that the waterproof protective cover 6 is damaged due to the pressure during assembly. It effectively protects the waterproof protective cover 6 and improves the protective effect of the waterproof protective cover 6 to the trigger switch.

In some embodiments, as shown in FIG. 7 to FIG. 9, the groove wall of the assembly groove 63 include two opposite side groove walls 631. The wall thickness T2 of both the two side groove walls 631 is greater than the wall thickness of the cover body 61, which can enhance the connection strength between the assembly component 64 and the switch bracket 71, result in a better structural stability, and avoid occurrence of the phenomenon that the waterproof protective cover 6 is damaged due to pressure during assembly.

It should be noted that, as shown in FIG. 5 and FIG. 9, the wall thickness T2 of the side groove wall 631 is the dimension of the side groove wall 631 along the direction from the trigger component 5 to the trigger switch 4 (Z-direction in FIG. 5 and FIG. 9).

The wall thicknesses T2 of both side groove walls 631 are greater than the wall thickness T1 of the cover body, which can ensure the trigger sensitivity while can avoid occurrence of the phenomenon that the assembly component is damaged due to pressure during assembly.

Specifically, the wall thickness of the two side groove walls is equal, which can make the waterproof protective cover 6 more evenly forced during assembly, less prone to damage, and better connection and coordination effect with the switch bracket 71. It improves the overall stability.

In some embodiments, as shown in FIG. 4 to FIG. 9, the mounting member 11 includes a support wall 113 arranged horizontally and an abutment wall 114 extending from the outer edge of the support wall 113 to the direction away from the water reservoir cavity 32. The outer wall of the assembly component 64 is formed with a first matching surface 641 arranged horizontally and a second matching surface 642 extending from the edge of the first matching surface 641 to the direction away from the cover body 61. Specifically, when the waterproof protective cover 6 is connected with the mounting member 11, the first matching surface 641 is located at the support wall 133 and is sealed and connected with the support wall 133, while the second matching surface 642 abuts against the abutment wall 114.

In other words, when the waterproof protective cover 6 is connected with the mounting member 11, the first matching surface 641 of the waterproof protective cover 6 connects and fits to the support wall 113 of the mounting member 11, and the abutment wall 114 of the mounting member 11 adheres to the second matching surface 642 of the waterproof protective cover 6, which further improves the sealing performance of the connection between the waterproof protective cover 6 and the mounting member 11 and further improves the protective effect of the waterproof protective cover 6 to the trigger switch 4.

Figure 4:
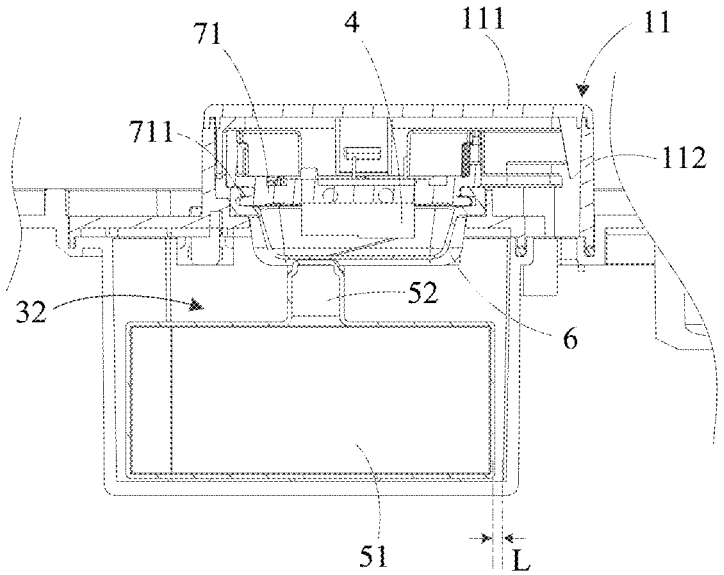
FIG. 4 is a sectional structural diagram of a part of the humidifier according to the embodiment in the present disclosure.

In some embodiments, as shown in FIG. 4, the trigger component 5 is a float, wherein a float gap L is provided between the float and an inner wall of the water reservoir cavity 32 for the float to float up and down. In other words, the float located in the water reservoir cavity 32 is gap matched with a cavity wall of the water reservoir cavity 32. It can prevent the float from being stuck during the rising and falling process in a certain degree and ensure that the float can rise and fall smoothly when the water level of the water reservoir cavity 32 changes. It further improve the timeliness and sensitivity of controlling the trigger switch 4.

As shown in FIG. 4, specifically, the float gap can be set between 0.5 mm and 1.5 mm.

In some embodiments, a guiding structure is also set between the water reservoir cavity 32 and the float for guiding the float.

The guiding structure has a guiding effect on the movement of the float along the Z-direction in the water reservoir cavity 31 by setting the guiding structure. It can avoid occurrence of the phenomenon that the float leans as the float moves towards nearer or farther away from the waterproof protective cover 6 and further prevent the float from getting stuck, which can enable the float to effectively push upward the waterproof protective cover 5, and further accurately trigger the trigger switch 4, thereby improving the sensitivity of the trigger control and further improving the safety of use.

Figure 6:
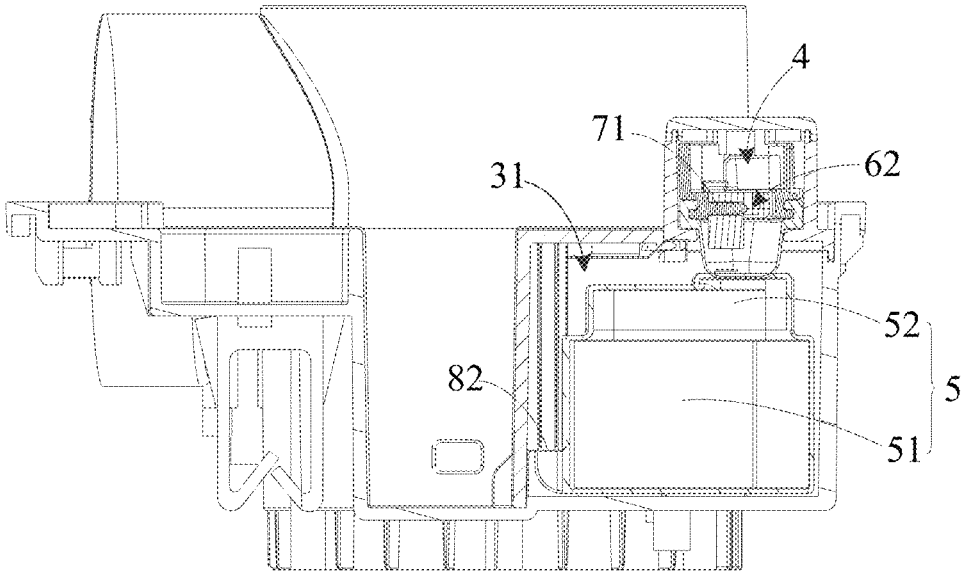
FIG. 6 is a sectional structural diagram of another part of the humidifier according to the embodiment in the present disclosure.

In some implementations, as shown in FIG. 3 and FIG. 6, the guiding structure includes a guiding groove 81 provided at a side wall of the float and a guiding rib 82 provided at the cavity wall of the water reservoir cavity 32. When the float floats up and down, the guiding rib 82 moves along the guiding groove 81.

By setting the guiding structure as the guiding groove and the guiding rib that cooperate with each other, the structure is simple and easy to fabricate. At the same time, the guiding effective is good, which can improve the accuracy of the float triggering the trigger switch 4.

In other implementations, the guiding structure also includes the guiding rib provided at the side wall of the float and the guiding groove provided at the cavity wall of the water reservoir cavity 32.

In some embodiments, as shown in FIG. 3 and FIG. 6, a support 72 is set in the water reservoir cavity 32, wherein the support 72 and a portion of the cavity wall of the water reservoir cavity 32 form a lifting cavity and the support 72 is provided with a water guiding hole 73. the water in the water reservoir cavity 32 can enter into the lifting cavity through the water guiding hole 73, and the float is installed in the lifting cavity and can lift relative to the support 72. In specific implementation, the guiding rib 82 can be set, for example, on one side of the support 72 toward the float.

In some embodiments, as shown in FIG. 3 to FIG. 6, the float includes a float body 51 and a trigger member 52 provided at the side of the float body 51 toward the waterproof protective cover 6. The trigger member 52 can be used to push upward the waterproof protective cover 6 for triggering the trigger switch.

In some embodiments, the trigger member can be, for example, a convex part for lifting the waterproof protective cover 6, which is convenient for pushing upward and has a high pushing upward effect.

In some implementations, an anti-sticking protrusion is provided at one side of the float that deviates from the trigger member 52. The anti-sticking protrusion can enable in a certain degree the float overcome the tension of the water in the water reservoir cavity 32, which thereby can avoid occurrence of the phenomenon that the float sticks in the inner bottom wall of the water reservoir cavity 32 and not floating up.

In some embodiments, the anti-sticking protrusion can be composed of multiple small protrusions provided at intervals.

Figure 2:
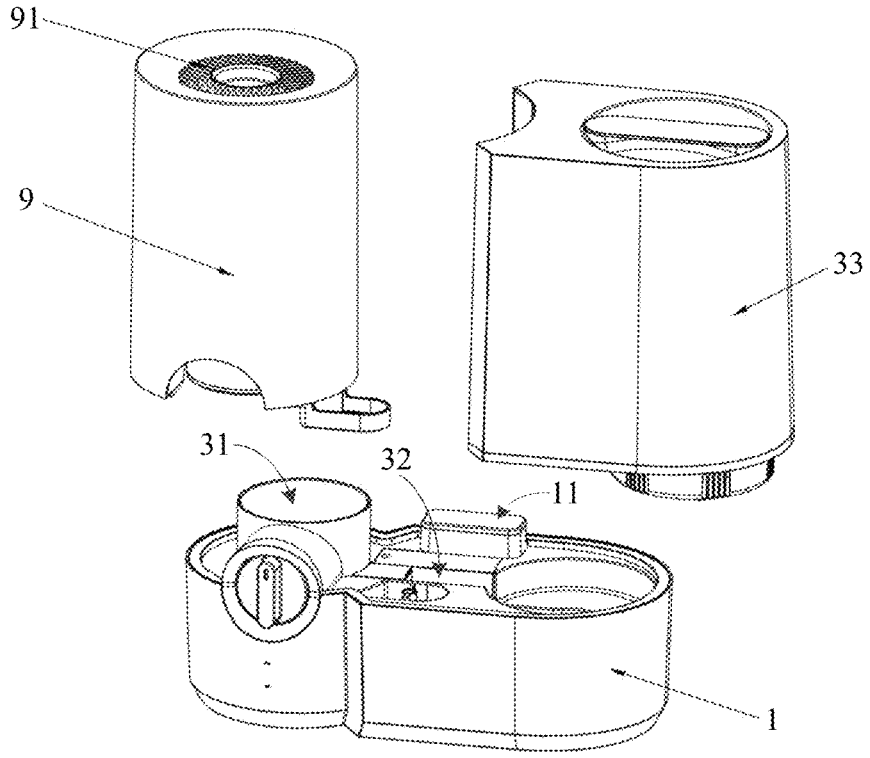
FIG. 2 is an exploded structural diagram of the humidifier according to the embodiment in the present disclosure.

In some embodiments, as shown in FIG. 1 and FIG. 2, the humidifier further comprises water tank 33 provided at the base 1, wherein the water tank 33 can connect with the water reservoir cavity 32 and supply water to the water reservoir cavity 32. when the humidifier comprises the mist exhausting assembly 9, the mist exhausting assembly 9 is specifically located at one side of the water tank 33.

The water trough 31 can connect with the water tank 33 through the water reservoir cavity 32, which can make the water in the water tank 33 flows into the water trough 31 through the water reservoir cavity 32. In specific use, the heating component 2 can heat the water in the water trough 31 for forming mist, which can be discharged from the mist exhausting assembly 9 to humidify the air.

Specifically, when the water level in the water reservoir cavity 32 rises to the first predetermined water level line, the trigger switch is triggered, and the water tank 33 stops supplying water to the water reservoir cavity 32; when the water level in the water reservoir cavity 32 falls to the second predetermined water level line, the trigger switch 4 is cut down, the water tank 33 continues to supply water to the water reservoir cavity 32, wherein the second predetermined water level line is lower than the first predetermined water level line.

Achieving automatic water supply when lack of water by changing of the water level in the water reservoir cavity 32 can ensure the normal operation of the humidifier, improve the safety of use and flexibility of the humidifier, and improve the user experience.

Exemplarily, when the water level reaches the first predetermined water level line or above, the float can overcome the elastic force of the switch spring of the trigger switch 4. The float can push upward the waterproof protective cover 6 for pushing upward the switch spring to trigger the trigger switch 4 to conduct. The trigger switch 4 can control the heating component 2 to heat the water in the water trough 31 for forming mist, which can be discharged through the mist exhausting assembly 9 to humidify the air. When the water level falls to or below the second predetermined water level line, in other words, the water level in the water reservoir cavity 32 is low or lack of water, the pushing force in the switch spring of the trigger switch 4 disappears, the switch spring resets and the trigger switch is cut down, the water tank 3 continues to supply water to the water reservoir cavity 32. For example, as the water level rises, the trigger switch 4 is triggered when the water level rises to the first predetermined water level line, which can improve the safety of use of the humidifier and has a better user experience.

It should be noted that, in the present disclosure, the relation term such as "first" and "second" are only used to distinguish one entity or operation from another entity or operation, and do not necessarily require or imply an actual relationship or order between the entities or operations. Moreover, the terms "include," "comprise" or any other variation thereof are intended to encompass non-exclusive inclusion, which can enable process, method, item or device comprising a series of elements not only include the elements, but also include other elements that are not explicitly listed, or also include elements inherent to the process, method, item or device. Without more limitations, the element associated with "include one . . . " does not exclude the existence of other identical elements in the process, method, item or device that includes the same elements.

The above described is only a specific implementation of the embodiment of the present disclosure, which enables the people skilled in the art to understand or implements the embodiment of the present disclosure. The various modifications of the embodiments will be apparent to the people skilled in the art, and the general principles defined in the present disclosure can be implemented in other embodiments without departing from the spirit or scope of the embodiments of the present disclosure. Therefore, the embodiments of the present disclosure will not be limited to the embodiments described herein, but will conform to the widest range consistent with the principles and novel features of the embodiments of the present disclosure described herein.

What is claimed is:

1. A humidifier comprises:

a base including a water reservoir cavity;

a trigger switch provided at the base, an outer side of the trigger switch being provided with a waterproof protective cover; and a trigger component located in the water reservoir cavity and configured to, in response to a water level in the water reservoir cavity rising to a predetermined water level line, push the waterproof protective cover to trigger the trigger switch to control the humidifier to work;

wherein a wall thickness of the waterproof protective cover at a position where the waterproof protective cover contacts the trigger component is less than a wall thickness of the waterproof protective cover at other positions of the waterproof protective cover.

2. The humidifier according to claim 1, further comprising:

a heating component;

wherein:

the predetermined water level line is a first predetermined water level line;

the base further includes a water trough connected with the water reservoir cavity;

the heating component is configured to heat water in the water trough to form mist; and the trigger switch is configured to:

be triggered to turn on the heating component in response to the water level rising to the first predetermined water level line, and be cut down to turn off the heating component in response to the water level falling to a second predetermined water level line lower than the first predetermined water level line.

3. The humidifier according to claim 1, wherein:

the trigger switch is located above the trigger component;

the waterproof protective cover includes a cover body covering at least a side of the trigger switch facing towards the trigger component; and the trigger component is configured to, in response to the water level rising to the predetermined water level line, push a bottom wall of the cover body to trigger the trigger switch to control the humidifier to work.

4. The humidifier according to claim 3, wherein a wall thickness of the bottom wall of the cover body is smaller than or equal to a wall thickness of the cover body at other positions of the cover body.

5. The humidifier according to claim 3, wherein:

the base is provided with a mounting member located above the water reservoir cavity;

the trigger switch is installed at the mounting member; and the waterproof protective cover further includes an assembly component provided at the cover body and connected with the mounting member in coordination, a wall thickness of the assembly component being greater than a wall thickness of the cover body.

6. The humidifier according to claim 5, wherein:

the assembly component includes an assembly groove;

the mounting member is provided with a convex part configured to, in response to the waterproof protective cover being connected with the mounting member, enter into the assembly groove; and a wall thickness of a groove wall of the assembly groove is greater than the wall thickness of the cover body.

7. The humidifier according to claim 6, wherein:

the convex part is sealed and matches with the assembly groove; and/or one side of the cover body that is away from the trigger component includes an opening at least for the trigger switch to enter, and the assembly component is provided at the opening; and/or the assembly groove includes a circular assembly groove arranged along a circumference of the cover body; and/or the groove wall of the assembly groove includes two opposite side groove walls, wall thicknesses of both the two side groove walls are greater than the wall thickness of the cover body, and the wall thicknesses of the two side groove walls are equal.

8. The humidifier according to claim 5, wherein:

the mounting member includes a support wall arranged horizontally and an abutment wall extending from an outer edge of the support wall in a direction away from the water reservoir cavity;

an outer wall of the assembly component is formed with a first matching surface arranged horizontally and a second matching surface extending from an edge of the first matching surface in a direction away from the cover body;

when the waterproof protective cover is connected with the mounting member, the first matching surface is located at the support wall and is sealed and connected with the support wall, and the second matching surface abuts against the abutment wall.

9. The humidifier according to claim 1, wherein the trigger component includes a float, and a floating gap exists between the float and an inner side wall of the water reservoir cavity for the float to move up and down.

10. The humidifier according to claim 9, further comprising:

a guiding structure arranged between the water reservoir cavity and the float, and configured to guide the float.

11. The humidifier according to claim 10, wherein the guiding structure includes:

a guiding groove provided at one of the side wall of the float and the cavity wall of the water reservoir cavity; and a guiding rib provided at other one of the side wall of the float and the cavity wall of the water reservoir cavity, and configured to move along the guiding groove when the float moves up and down.

12. The humidifier according to claim 9, wherein the float includes:

a float body; and a trigger member provided at a side of the float body facing toward the waterproof protective cover, and configured to push the waterproof protective cover to trigger the trigger switch.

13. The humidifier according to claim 1, further comprising:

a water tank provided at the base, the water tank being connected with the water reservoir cavity and configured to supply water to the water reservoir cavity;

wherein:

the predetermined water level line is a first predetermined water level line; and the water tank is configured to:

stop supplying water to the water reservoir cavity in response to the water level rising to the first predetermined water level line; and resuming to supply water to the water reservoir cavity in response to the water level falling to a second predetermined water level line lower than the first water level line.

14. The humidifier according to claim 13, further comprising:

a heating component;

wherein:

the base further includes a water trough connected with the water reservoir cavity;

the heating component is configured to heat water in the water trough to form mist; and the trigger switch is configured to:

be triggered to turn on the heating component in response to the water level rising to the first predetermined water level line, and be cut down to turn off the heating component in response to the water level falling to a second predetermined water level line lower than the first predetermined water level line.

15. The humidifier according to claim 13, wherein:

the trigger switch is located above the trigger component;

the waterproof protective cover includes a cover body covering at least a side of the trigger switch facing towards the trigger component; and the trigger component is configured to, in response to the water level rising to the first predetermined water level line, push a bottom wall of the cover body to trigger the trigger switch to control the humidifier to work.

16. The humidifier according to claim 15, wherein a wall thickness of the bottom wall of the cover body is smaller than or equal to a wall thickness of the cover body at other positions of the cover body.

17. The humidifier according to claim 15, wherein:

the base is provided with a mounting member located above the water reservoir cavity;

the trigger switch is installed at the mounting member; and the waterproof protective cover further includes an assembly component provided at the cover body and connected with the mounting member in coordination, a wall thickness of the assembly component being greater than a wall thickness of the cover body.

18. The humidifier according to claim 17, wherein:

the assembly component includes an assembly groove;

the mounting member is provided with a convex part configured to, in response to the waterproof protective cover being connected with the mounting member, enter into the assembly groove; and a wall thickness of a groove wall of the assembly groove is greater than the wall thickness of the cover body.

19. The humidifier according to claim 18, wherein:

the convex part is sealed and matches with the assembly groove; and/or one side of the cover body that is away from the trigger component includes an opening at least for the trigger switch to enter, and the assembly component is provided at the opening; and/or the assembly groove includes a circular assembly groove arranged along a circumference of the cover body; and/or the groove wall of the assembly groove includes two opposite side groove walls, wall thicknesses of both the two side groove walls are greater than the wall thickness of the cover body, and the wall thicknesses of the two side groove walls are equal.

20. The humidifier according to claim 13, wherein the trigger component includes a float, and a floating gap exists between the float and an inner side wall of the water reservoir cavity for the float to move up and down.

* * * * *